United States Patent [19]

Hauber

[11] 4,160,560

[45] Jul. 10, 1979

[54] SLIDING DOOR LOCK ASSEMBLY

[76] Inventor: Peter F. Hauber, 7846 Shady Spring Dr., Burbank, Calif. 91504

[21] Appl. No.: 878,681

[22] Filed: Feb. 17, 1978

[51] Int. Cl.[2] ..... E05C 19/12; E05B 9/08

[52] U.S. Cl. ..... 292/101; 292/337; 292/DIG. 46; 292/DIG. 53

[58] Field of Search ..... 292/101, 128, 337, DIG. 46, 292/DIG. 53, DIG. 64; 70/100, 84, 95, 462

[56] References Cited

U.S. PATENT DOCUMENTS

| | | | |
|---|---|---|---|
| 2,779,186 | 1/1957 | Grevengoed et al. | 292/337 X |
| 2,919,571 | 1/1960 | Welch | 292/337 X |
| 2,946,612 | 7/1960 | Ahlgren | 292/337 X |
| 3,596,954 | 8/1971 | Hull et al. | 292/128 |
| 3,841,674 | 10/1974 | Bisbing et al. | 292/DIG. 53 X |
| 4,068,874 | 1/1978 | Fleming et al. | 292/DIG. 46 X |

*Primary Examiner*—Roy D. Frazier
*Assistant Examiner*—William E. Lyddane
*Attorney, Agent, or Firm*—Louis J. Bachand

[57] ABSTRACT

A sliding door lock apparatus is provided comprising a housing carrying a holddown tongue and a mounting bracket therefor which has a particularly sized aperture for receiving the housing in angled relation for lock apparatus assembly, and for thereafter securely retaining the housing against vertical movement in a coplanar alignment of the housing frontal portion and the mounting bracket aperture.

10 Claims, 13 Drawing Figures

SLIDING DOOR LOCK ASSEMBLY

BACKGROUND OF THE INVENTION

This invention has to do with sliding door lock apparatus, and more particularly, is concerned with improvements in sliding door lock apparatus for increased ease of mounting and for increased security when mounted.

Sliding door locks are provided on the stiles of sliding doors for locking engagement with keeper structure set in the door jamb.

A highly desirable type of sliding door lock comprises a latch, actuable between locked and unlocked positions by a latch arm, and a hold-down tongue which projects into the keeper in a manner preventing the lifting displacement of the stile relative to the jamb thereby to prevent break-ins up to the limit of the strength of the materials of the lock apparatus.

Numerous sliding door locks have been proposed and many different types are currently in use. A highly desirable feature in sliding door locks is universal mounting capability. Universal mounting capability refers to a property of a sliding door lock which enables the lock to be installed right side up or inverted or with the mounting hardware or latch controls inside or outside the door stile. Since there are right and left hand doors, and inside and outside installations of doors, it is necessary to have the capability of universal mounting in the most desirable sliding door lock apparatus.

PRIOR ART

Prior efforts at providing suitable sliding door lock apparatus include those set forth in U.S. Pat. No. 3,596,954 to Hull et al. This patent describes a sliding door lock apparatus having a projecting latch and a hold-down tongue in longitudinally spaced relation which interfit with corresponding slots in the mounting bracket, security being provided by the engagement of the hold-down tongue with the perimeter of the slot into which the hold-down tongue is inserted, in the mounted condition of the lock apparatus. The Hull lock apparatus further includes a base element of complex configuration to receive the lock per se which is carried in a separable cartridge. The base cartridge and mounting panel are then assembled in an installation by attachment to a door stile. The complexity of the components of the Hull device precludes economical production of the device and gives rise to the inventory control problems for installers, as well as difficulty in actual installation.

The problem with the Hull device more particularly is that the hold-down tongue projecting from the lock cartridge necessitates separable apparatus components because of its bulk and thus causes difficulties with ready assembly. Nonetheless, the hold-down tongue is a highly desirable feature in a sliding door lock and has been known long prior to the Hull et al patent.

SUMMARY OF THE INVENTION

It is accordingly a major objective of the present invention to provide a sliding door lock apparatus featuring a hold-down tongue as well as a latch which is readily mounted in any of the desired orientations, right side up, up side down, left or right, inside or outside, and which is easily installed in the field by relatively unskilled workers. It is a further objective of the present invention to provide a lock housing which carries the hold-down tongue but which none the less is readily installed in a mounting bracket. It is still another object of the invention to provide a lock housing mountable in a mounting bracket which is particularly configured relative to a mounting aperture in the mounting bracket to enable ready passage of the housing through the mounting aperture in angled relation and to enable secure engagement of the housing when the mounting bracket aperture and the lock housing are coplanar. It is a still further object of the invention to provide a mounting bracket having first and second apertured panels, the first panel readily passing a lock housing therethrough in angled relation for righting and interengagement with the panel aperture while the second panel selectively passes a latch operating arm in the mounted condition of the lock housing. Still another object is to provide a clip means for securely engaging the frontal portion of the lock housing with the front panel aperture against relative displacement of the door stile from the jamb in the locked condition of the apparatus. Other objects will become apparent hereafter.

More particularly, the invention provides a a sliding door lock apparatus comprising a separable generally rectangular housing carrying a selectively operable latch, and longitudinally thereof, a fixed hold-down tongue in universally mountable relation, and a housing mounting bracket comprising an apertured panel securing the housing to a sliding door stile for selective, cooperative locking engagement of the latch and tongue with the keeper of a door jamb opposite the bracket panel; the improvement comprising the housing having a reduced frontal portion, the panel aperture means being housing frontal portion-registerable and proportioned to freely pass or block passage of the housing responsive to the angular relation therebetween, the housing frontal portion defining a universal locus of coplanar engagement with the aperture means against relative movement of the housing and the bracket independently of the mounting orientation of the housing to block unwanted displacement of the door stile from the door jamb in the locked condition of the apparatus.

In particular, the mounting bracket panel may comprise a first bracket panel and the apparatus further include a second bracket panel parallel with the first panel and spaced therefrom a distance permitting angled insertion of the housing through the first panel aperture means and further including insert means cooperating with the first and second bracket panels to support the housing mounted on the bracket in panel spacing overcoming relation. The mentioned insert means may comprise in preferred embodiments a longitudinally flexible, terminally lobed strip of substantially incompressible thickness having integral fastening means thereon and adapted to be secured to the second bracket panel, in blocking relation to housing frontal portion disengagement from the first panel aperture means.

Further, the housing may be forwardly locally corner notched to define the frontal portion and interfit with the panel means in engagement locus defining relation, the housing further being rearwardly oppositely corner radiused to facilitate angled insertion beyond the panel aperture means.

Suitably, the housing and the hold-down tongue are integrally cast and the housing is symmetrical about its longitudinal and transverse axes.

In the more particular preferred embodiments of the invention, the housing further carries a rearwardly projecting pivotally mounted latch arm for operating the mentioned latch. The mounting bracket further comprises a channel member having a base, a first wall formed at a right angle to the base and defining the housing-passing bracket panel and a second wall also formed at a right angle to the base opposite and parallel to the first wall and defining a second bracket panel having an aperture formed therein opposite the first panel aperture means and sized selectively to receive the latch arm in the mounted condition of the housing. In such embodiments, the first and second bracket panels may be closely spaced a predetermined distance greater than the depth front to rear of the housing, permitting limited angular insertion of the housing therebetween. Further provided are clip means separably securable between the housing and the second bracket panel, such clip means being dimensioned relative to the mentioned predetermined distance and housing depth to make up the distance therebetween and block the housing into frontal engagement perimetrically within the first bracket panel aperture means. As in other embodiments, the housing typically is forwardly locally terminally notched to define the frontal portion thereof and interfit with the first panel aperture means in engagement locus defining and clip means urged relation, the housing being rearwardly oppositely terminally corner radiused to facilitate housing manipulation between the first and second bracket panels. As earlier noted, the clip means in the preferred embodiments will comprise a longitudinally flexible, terminally lobed strip of substantially incompressible thickness having integral fastening means thereof; the fastening means typically may comprise notched ends adapted to be snap fit—secured to the second bracket panel aperture, in blocking relation to housing frontal portion disengagement from the first panel aperture means. In preferred embodiments as earlier mentioned, the housing and hold-down tongue are integrally cast with the housing being symmetrical about its longitudinal and transverse axes for universal mounting in operative relation with the first panel aperture means. The channel member walls, it will be noted, define with the door stile an enclosed space surrounding the housing, such channel member typically further including a pull or handle defining flange.

BRIEF DESCRIPTION OF THE DRAWINGS

The invention will be further described as to an illustrative embodiment thereof in conjunction with the attached drawings in which.

DETAILED DESCRIPTION OF THE INVENTION

Figure 1:
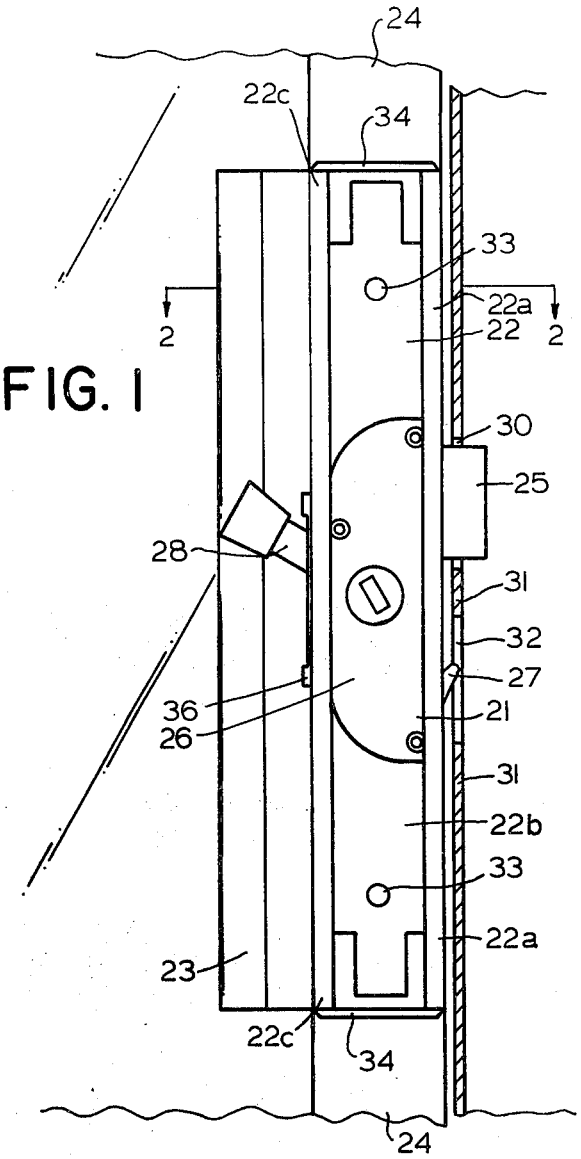
FIG. 1 is a side view of the present sliding door apparatus taken approximately in the plane of a door stile to which the apparatus is mounted, and showing the opposing door jamb in section.

FIG. 1 is a side view of the lock assembly as viewed from the door on which this assembly is attached. The direction of door travel while closing is to the right, so that, when closed, the door stile 24 contacts the door jamb 31.

The bracket 22 which holds the cartridge 21 in place on the door stile 24 comprises forward 22*a*, side 22*b* and rear 22*c* panels and a handle 23, and is attached to the door 24 by screws through holes 33 in the bracket 22. To improve the appearance of the unit, caps 34 are provided at the top and bottom of the bracket 22.

The cartridge 21 comprises a housing 26, a latch 27, a hold-down 25 and a latch arm 28. This cartridge is first inserted through the bracket slot 41, not shown in this view, in the forward panel 22*a* of the bracket 22 and is then locked in place by the clip 36.

The direction of door travel, while closing is to the right. In the door's closed position, the hold-down 25 fits into a hold-down keeper 30 and the latch 27 fits into a latch keeper 32 in the door jamb 31. The latch in this figure is shown in its open or unlatched position. Upon latching, the latch will enter the latch keeper 32 and hook behind the door jamb 31.

Figure 2:
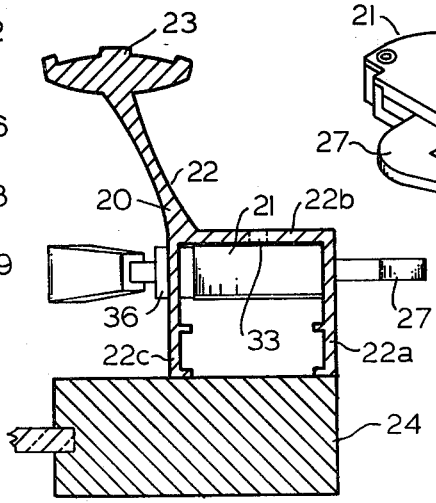
FIG. 2 is a top plan view of the sliding door lock apparatus of the invention, the mounting bracket having been partially cut away to reveal the underlying parts.

A sectional top view at the line 2—2 in FIG. 1 is shown in FIG. 2. The bracket 22, which is extruded in long sections and cut into pieces of about seven or eight inches for this application, comprises a forward panel 22*a*, a side panel 22*b*, a rear panel 22*c* and a handle 23. A hole 33 is provided to attach the bracket 22 to the stile 24. The door closes to the right, allowing the latch 27 to mate with a latch keeper 32 in the door jamb 31, not shown.

Figure 3:
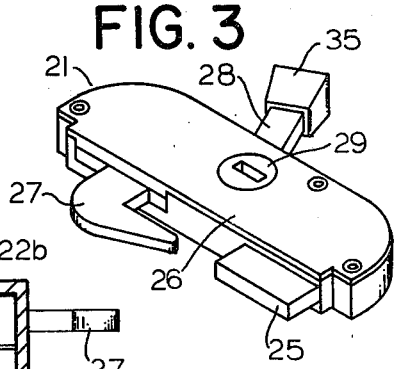
FIG. 3 is a perspective view of the lock housing and its components.
Figure 5:
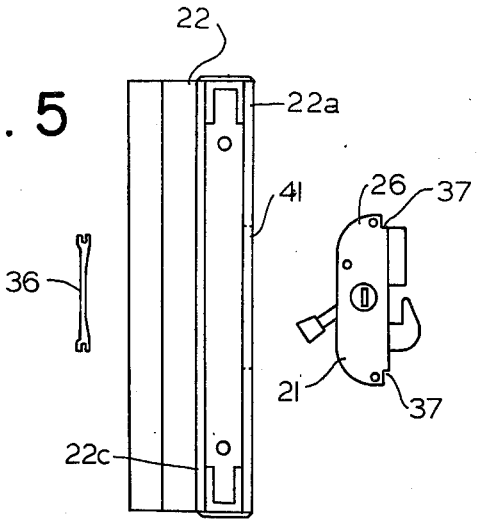
FIGS. 5 through 9 are side elevational views depicting assembly stages in an installation of the present apparatus.

An isometric view of the cartridge 21 is shown in FIG. 3. The housing 26 is formed integrally with the hold-down 25. A latch 27 and latch arm 28 are formed from a single piece of metal stock and pivotally mounted at pivot point 29. An optional cap 35 is provided at the end of the latch arm 28.

Figure 4:
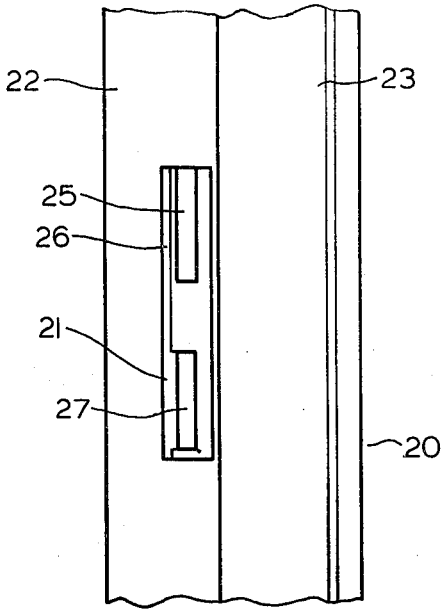
FIG. 4 is a front elevational view of the apparatus.

FIG. 4 is a front view of the mounting bracket 22 as viewed from the door jamb. In this view, the bracket 22 and its handle 23 are shown, as are the cartridge 21, comprising the housing 26, the hold-down 25 and the latch 27.

Figure 12:
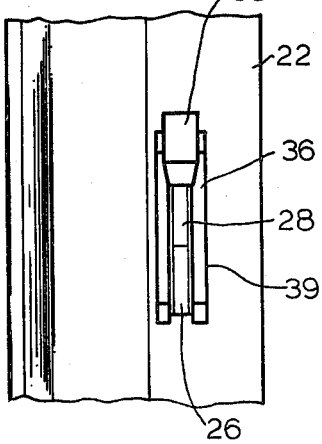
FIG. 12 is a rear elevation of the apparatus.

A rear view of the lock assembly is provided in FIG. 12 which shows the latch arm slot 39 through which protrudes the latch arm 28. For decorative purposes, the latch arm 28 may have a knob 35, made of plastic in the described embodiment. The housing 26 is locked in place by means of a clip 36.

Figure 6:
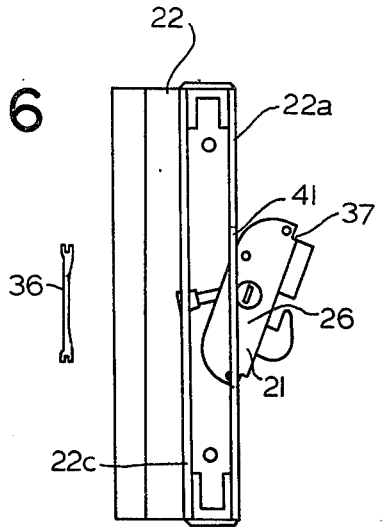
Figure 7:
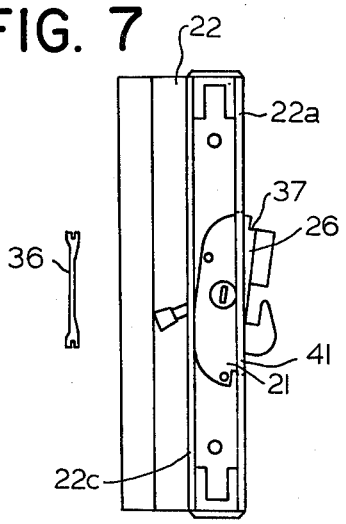
Figure 8:
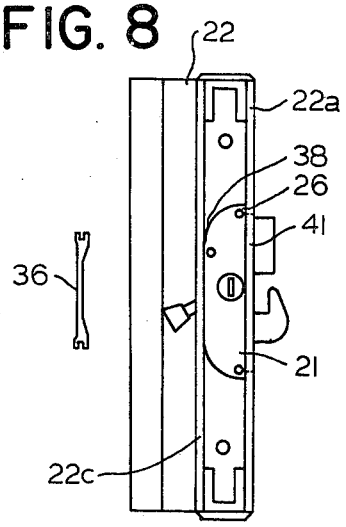

The installation of the cartridge 21 in the bracket 22 is shown in FIGS. 5 through 9, which are side views of the mounting bracket 22. The cartridge 21 is rotated through a tight-fitting bracket slot 41 in the forward panel 22*a* as shown in FIGS. 6 and 7. When the cartridge 21 is in the correct position, it is seated so that the mounting locus 27 of the housing 26 occupies the bracket slot 41. This creates a space 38 in FIG. 8 between the rear of the housing 26 and the channel member rear panel 22*c* which is filled by the clip 36, a flexible, notched strip of metal or plastic. This clip 36 fills the space between the housing 26 and the channel member rear wall 22c thereby forcing the cartridge 21 to be locked into the bracket slot 41 on the mounting locus 37.

Figure 10:
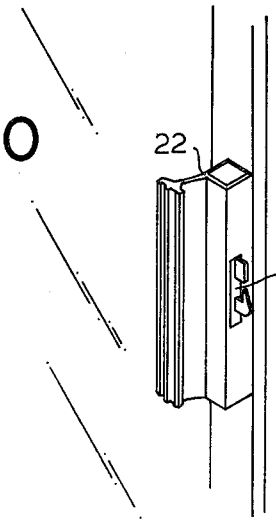
FIG. 10 is a perspective view of a left hand sliding door lock installation.
Figure 11:
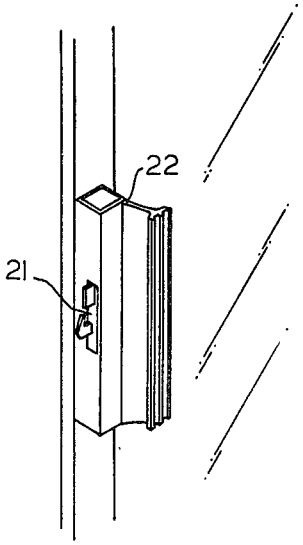
FIG. 11 is a view like FIG. 10 showing a right hand sliding door installation.

FIGS. 10 and 11 are isometric views showing the left and right handed installations. Either the cartridge 21 or the mounting bracket 22 may be inverted for the particular installation.

Figure 13:
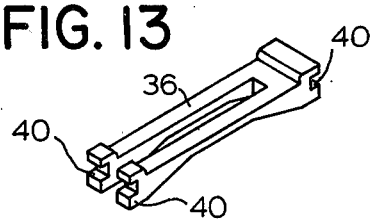
FIG. 13 is a perspective view of a mounting clip according to this invention.
Figure 9:
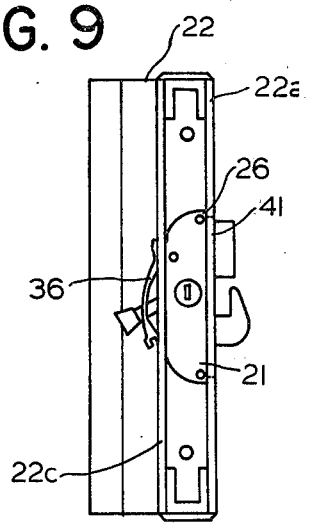

FIG. 13 is a detailed isometric view of the clip 36. Upon being installed in the latch arm slot 39 as shown in FIGS. 9 and 12, the bottom of the clip 36 contacts the rear of the housing 26 while the clip ends 40 grip the rear panel 22c of the bracket 22. This fills the space 38 between the housing 26 and the rear panel 22c after the cartridge 21 has been seated in the bracket slot 41.

It can now be seen that the stated objects are achieved through the use of this invention.

This apparatus can be manufactured at low cost. The mounting bracket 22 is a single long aluminum extrusion or equivalent, cut into sections, and capped with plastic caps 34. The cartridge 21 is a separate unit which is manufactured and stored separately until needed. Finally, the clips 36 are one piece flexible metal or plastic parts.

Inventory is minimized since the same parts are used for right and left hand door lock assemblies. A screw driver is the only tool required to install this device. The cartridge 21 is rotated into the bracket slot 41 of the bracket 22 and the clip 36 is put in place by hand. The screw driver is used to fasten the bracket 22 to the stile 24 and to remove the clip 36 if and when necessary. No special skills are required of the installer.

A forced break-in is difficult because the housing 26, after installation, is seated behind the front panel 22a of the bracket 22. Thus, the force applied to break in must be sufficient either to pull apart the cartridge 21 or the bracket 22.

For these reasons, this door lock assembly is a significant improvement over those described in the prior art.

This invention has been discussed in terms of a sliding door but is equally usable for any sliding closure.

The above described embodiments of this invention are merely descriptive of its principles and are not to be considered limiting. The scope of this invention instead shall be determined from the scope of the following claims, including their equivalents.

What is claimed is:

1. A sliding closure lock assembly comprising:

a bracket adapted to be secured to said closure, comprising a bracket wall having a front wall panel with a slot therein normal to the plane of movement of said closure;

a separately formed lock cartridge comprising a housing insertable through said slot in the closure secured condition of said bracket, said housing having a front face with a dimension greater than the corresponding dimension of said slot and a projecting front face portion registered within said slot and defining a mounting locus, said housing being contoured in its longitudinal dimension for relatively angled insertion into said slot in a direction parallel to the plane of movement of said closure, and for reorientation in said plane to position said face registration with said front wall panel slot; and means rearwardly of said housing engaging said bracket cooperatively with said front wall panel slot blocking said housing into fixed engagement at its mounting locus with said front wall panel slot in said face portion registered relation, said cartridge including a latch member selectively extendible out of said housing face portion parallel to said closure movement plane.

2. The sliding closure lock assembly according to claim 1 in which said housing has a rear face, and including also a latch operating arm projecting beyond said housing rear face.

3. The sliding closure lock assembly according to claim 2 in which said housing has mirror image upper and lower housing sections for reverse insertion and engagement of said cartridge in the same wall slot.

4. The sliding closure lock assembly according to claim 1 including also a hold-down tongue carried by said housing in a common plane with said latch.

5. The sliding closure lock assembly according to claim 1 wherein said housing mounting locus is defined by a housing longitudinal axial dimension greater than the corresponding dimension of said slot.

6. The apparatus of claim 1 in which said bracket has a forward panel defining said wall and including also a rear panel parallel to said forward panel and spaced therefrom a distance permitting angled insertion of said housing through said bracket slot, and wherein said blacking means comprises separately formed clip means cooperating with said rear panel to support said housing mounting locus in contact with said forward panel.

7. The apparatus of claim 6 wherein said housing is forwardly corner notched to define said projecting front face portion and mounting locus, and has rounded rear corners to facilitate angled insertion of said housing into the space between said forward and rear panels.

8. The apparatus of claim 7 wherein said rear panel has a slot sized to allow the projection and operation of a latch operating arm through said rear panel, and wherein said clip means fastens onto the edges of the rear panel at said rear panel slot and fills the space between housing and rear panel when said housing is in its secured position.

9. Apparatus of claim 8 wherein said bracket further includes a handle defining flange.

10. A sliding closure lock assembly comprising:

a bracket adapted to be secured to said closure comprising:

(a) a forward panel having a slot therein;

(b) a rear panel having a slot therein; and (c) a handle defining flange;

a separately formed lock cartridge comprising:

(a) a housing adapted for angled insertion through the slot in said forward panel, and for reorientation in the plane of said forward panel, said housing defining a front face and a perimetrical mounting locus therebehind for housing face registration with said forward panel slot and fixed engagement of said mounting locus with the opposing slot edges in coplanar relation there with when said housing is reorientated and held against said forward panel, said housing having rounded rear corners to facilitate insertion through said forward panel and into the space between forward and rear panels, said housing having forward corner notches defining said mounting locus;

(b) a hold-down tongue protuding from said front face for engaging a hold-down keeper in a cooperative jamb;

(c) a latch protruding from said front face for engaging a latch keeper in the jamb, and (d) a latch arm protruding through the slot in said rear panel, and a clip mounted in the slot of said rear panel and in blocking relation between said housing and said rear panel to hold said cartridge in fixed engagement with the slot of said forward panel.

* * * * *

UNITED STATES PATENT OFFICE

CERTIFICATE OF CORRECTION

Patent No. 4,160,560 Dated July 10, 1979

Inventor(s) Peter F. Hauber

It is certified that error appears in the above-identified patent and that said Letters Patent are hereby corrected as shown below:

Column 6, line 26, after "and" and before "mounting" insert ---said---.

Signed and Sealed this

*Thirteenth* Day of *May 1980*

[SEAL]

*Attest:*

SIDNEY A. DIAMOND

*Attesting Officer*

*Commissioner of Patents and Trademarks*